US009610490B2

(12) United States Patent
Tambornino et al.

(10) Patent No.: US 9,610,490 B2
(45) Date of Patent: Apr. 4, 2017

(54) WEIGHT STORAGE PEG FOR FITNESS APPARATUS

(71) Applicant: Dynamic Fitness & Strength, LLC, Eau Claire, WI (US)

(72) Inventors: Jason Tambornino, Chippewa Falls, WI (US); Curt Tambornino, Altoona, WI (US)

(73) Assignee: Dynamic Fitness & Strength, LLC, Eau Claire, WI (US)

( * ) Notice: Subject to any disclaimer, the term of this patent is extended or adjusted under 35 U.S.C. 154(b) by 0 days.

(21) Appl. No.: 14/527,474

(22) Filed: Oct. 29, 2014

(65) Prior Publication Data

US 2015/0114916 A1 Apr. 30, 2015

Related U.S. Application Data

(60) Provisional application No. 61/896,834, filed on Oct. 29, 2013.

(51) Int. Cl.

| | |
|---|---|
| ***A47F 7/00*** | (2006.01) |
| ***A63B 71/00*** | (2006.01) |
| ***A63B 21/06*** | (2006.01) |
| ***A63B 21/072*** | (2006.01) |
| ***A63B 17/04*** | (2006.01) |

(52) U.S. Cl.

CPC ..... *A63B 71/0036* (2013.01); *A63B 17/04* (2013.01); *A63B 21/06* (2013.01); *A63B 21/0724* (2013.01); *A63B 21/0728* (2013.01)

(58) Field of Classification Search

CPC . A63B 71/0036; A63B 21/06; A63B 21/0724; A63B 21/0728; A63B 17/04

USPC ..... 248/218.4, 220.21, 220.31, 224.1; 482/37–38, 41, 104, 94, 142

See application file for complete search history.

(56) References Cited

U.S. PATENT DOCUMENTS

| | | | | | |
|---|---|---|---|---|---|
| 145,914 | A | * | 12/1873 | Smith | A63B 67/06 273/338 |
| 763,221 | A | * | 6/1904 | Ullom | F01N 1/08 181/269 |
| 945,520 | A | * | 1/1910 | Greenwood | F41A 23/18 211/64 |
| 980,523 | A | * | 1/1911 | Heimer | B65G 39/09 193/37 |
| 1,084,850 | A | * | 1/1914 | Ford | B42F 13/12 411/338 |

(Continued)

OTHER PUBLICATIONS www.torquefitness.com, Commercial X6HWSR brochure, downloaded Oct. 16, 2014.

*Primary Examiner* — Joshua J Michener
*Assistant Examiner* — Devin Barnett
(74) *Attorney, Agent, or Firm* — Shewchuk IP Services, LLC; Jeffrey D. Shewchuk

(57) ABSTRACT

A weight storage peg for supporting free weight plates from an exercise superstructure includes a bar extending from a fastener. An exterior surface of the bar is provided by a nylon casting around a cylindrical tube weldment. The nylon casting tapers from a wider portion adjacent the free end to a narrower portion nearer the fastener. The nylon casting also provides a mounting flange around the head of a female threaded mounting bolt, with the female threaded mounting bolt welded to a cylindrical tube to form the cylindrical tube weldment.

8 Claims, 8 Drawing Sheets

(56) References Cited

U.S. PATENT DOCUMENTS 1,501,942 A * 7/1924 Carman ..... A63B 67/06 273/339
1,789,126 A * 1/1931 Aldeen ..... F25D 23/067 211/183
2,079,299 A * 5/1937 McKissick ..... B66D 3/046 254/390
2,356,835 A * 8/1944 Duckett ..... B23B 31/1173 192/81 C
2,841,693 A * 7/1958 Talbot ..... F21L 4/00 362/191
2,932,510 A * 4/1960 Kravitz ..... A63B 3/00 248/423
2,955,832 A * 10/1960 Gary ..... B23B 51/123 279/103
3,023,535 A * 3/1962 Holka ..... A01K 91/04 43/42.74
3,152,820 A * 10/1964 Giampa ..... A01K 87/02 273/DIG. 11
3,352,429 A * 11/1967 Magnuson ..... A47G 25/06 211/113
3,381,958 A * 5/1968 Gulland ..... A63B 22/001 482/37
3,478,636 A * 11/1969 Juzek ..... G10D 3/14 84/305
3,519,294 A * 7/1970 Barnes ..... F16B 7/025 403/265
3,606,023 A * 9/1971 Edmunds ..... A47B 73/006 211/194
3,606,315 A * 9/1971 Green ..... A63B 9/00 182/133
3,609,906 A * 10/1971 Johnson ..... A01K 87/02 403/334
3,709,487 A * 1/1973 Walker ..... A63B 17/00 297/118
3,830,008 A * 8/1974 Johnson ..... A01K 87/00 403/361
3,934,951 A * 1/1976 Stumpf ..... B65G 39/02 193/37
3,986,226 A * 10/1976 Roe ..... B05C 17/0217 15/230.11
4,005,628 A * 2/1977 Darling ..... G10D 3/14 84/304
4,033,243 A * 7/1977 Kirrish ..... F16B 37/145 411/338
4,083,140 A * 4/1978 Van Auken ..... A01K 87/00 403/179
4,152,086 A * 5/1979 Achenbach ..... B25G 3/28 403/297
4,286,782 A * 9/1981 Fuhrhop ..... A63B 21/078 482/103
4,310,273 A * 1/1982 Kirrish ..... F16B 5/0233 411/338
4,337,942 A * 7/1982 Sidlinger ..... A63B 5/11 482/142
4,360,198 A * 11/1982 Waulters ..... A63B 21/078 482/106
4,375,886 A * 3/1983 Muys ..... A63B 5/20 482/82
4,418,496 A * 12/1983 Koistinen ..... A01G 5/04 248/215
4,441,273 A * 4/1984 McMickle ..... A01K 87/02 403/334
4,441,706 A * 4/1984 Korzaniewski ..... A63B 21/06 482/102
4,563,002 A * 1/1986 Jardine ..... A63B 5/20 482/82
4,564,194 A * 1/1986 Dawson ..... A63B 21/154 482/102
4,637,608 A 1/1987 Owens et al.
4,638,995 A * 1/1987 Wilson ..... A63B 21/0004 297/452.13
4,765,616 A 8/1988 Wolff
4,772,011 A * 9/1988 Guridi ..... A63B 1/005 482/37
4,896,758 A * 1/1990 Hoszowski ..... B60B 19/12 193/37
4,903,962 A * 2/1990 Pollack ..... A63B 21/0728 482/106
4,911,438 A * 3/1990 Van Straaten ..... A63B 21/068 482/130
4,919,419 A * 4/1990 Houston ..... A63B 21/078 482/138
4,921,245 A 5/1990 Roberts
4,955,604 A * 9/1990 Pogue ..... A63B 21/0783 482/106
5,059,073 A * 10/1991 Revol ..... F16B 13/0833 411/342
5,069,458 A * 12/1991 Washington ..... A63F 3/00643 273/238
5,070,863 A * 12/1991 McArthur ..... A61H 1/0244 482/1
5,076,577 A * 12/1991 Houston ..... A63B 21/078 403/109.6
5,190,509 A * 3/1993 Davison, Jr. ..... A63B 21/153 482/100
5,242,342 A * 9/1993 Silverman ..... A63B 23/12 482/110
5,244,326 A * 9/1993 Henriksen ..... F16B 37/145 411/180
5,257,964 A 11/1993 Petters
5,284,458 A * 2/1994 Perry ..... A63B 21/169 482/121
5,306,220 A * 4/1994 Kearney ..... A63B 23/00 482/104
5,350,346 A * 9/1994 Martinez ..... A63B 21/078 482/104
5,387,171 A * 2/1995 Casey ..... A63B 21/0552 482/130
5,433,220 A * 7/1995 Kostich ..... A61B 6/0421 5/622
5,454,676 A * 10/1995 Conte ..... A63C 17/0006 411/339
5,496,242 A * 3/1996 Wang ..... A63B 21/0087 482/112
5,503,276 A * 4/1996 Pierce ..... F41A 23/18 211/59.1
5,607,130 A * 3/1997 Smay ..... F16M 11/24 248/125.3
5,607,380 A * 3/1997 Duty ..... A63B 21/00047 482/126
5,628,716 A * 5/1997 Brice ..... A63B 21/0728 482/106
5,704,749 A * 1/1998 Landgrebe ..... F16B 5/025 411/339
5,720,698 A * 2/1998 Dalebout ..... A63B 21/015 482/51
5,722,531 A * 3/1998 Zimny ..... B65G 15/02 198/831
5,755,823 A * 5/1998 Cleary ..... A63B 21/078 482/104
5,810,701 A * 9/1998 Ellis ..... A63B 23/12 482/136
5,813,550 A * 9/1998 Sheehan ..... A47F 5/0807 211/87.01
5,863,280 A * 1/1999 Wang ..... A63B 21/154 482/140
5,928,116 A * 7/1999 Chiang ..... A63B 23/1209 482/133
5,935,050 A * 8/1999 Shahan ..... A63B 23/0211 482/140
5,938,571 A * 8/1999 Stevens ..... A63B 21/068 482/135
D416,959 S * 11/1999 Tumminia ..... D21/662
5,979,752 A * 11/1999 Holloway ..... G01G 23/40 116/325
6,016,900 A * 1/2000 Longrod ..... B65G 39/12 193/35 F

(56) References Cited

U.S. PATENT DOCUMENTS 6,074,327 A * 6/2000 Franklin ..... A63B 69/0048 248/231.9
6,135,455 A * 10/2000 McNally ..... A63B 67/06 273/336
6,149,556 A * 11/2000 Jordan ..... A63B 21/078 482/104
6,164,439 A * 12/2000 Stebnicki ..... B65G 17/086 198/853
6,168,557 B1 * 1/2001 Liao ..... A63B 21/0615 482/140
6,185,864 B1 * 2/2001 Lee ..... A01G 9/083 47/47
6,210,302 B1 * 4/2001 Globus ..... A63B 15/00 482/106
6,217,483 B1 * 4/2001 Kallassy ..... A63B 21/068 482/38
6,241,175 B1 * 6/2001 Nichols ..... B65H 54/585 137/355.26
6,299,568 B1 * 10/2001 Prok ..... A63B 23/00 482/104
6,312,401 B1 * 11/2001 Smith ..... A61H 1/0218 482/142
D460,239 S * 7/2002 Nimmo ..... B65G 39/07 D34/29
6,689,022 B1 * 2/2004 Emick ..... A63B 21/06 482/93
D494,048 S * 8/2004 Goodman ..... D8/372
6,811,521 B1 * 11/2004 Musso ..... A63B 21/0626 482/104
7,004,894 B1 * 2/2006 Trotter ..... A63B 23/02 482/140
7,025,712 B2 * 4/2006 Parrilla ..... A63B 21/072 482/104
7,070,546 B1 * 7/2006 Grasso ..... A63B 21/072 482/103
7,104,938 B1 * 9/2006 Smith ..... A63B 21/06 482/104
7,114,613 B2 * 10/2006 Brouwer ..... B65G 13/04 198/784
7,131,937 B2 11/2006 Skilken et al.
D546,402 S * 7/2007 Sonnier ..... D21/662
D556,025 S * 11/2007 Kubota ..... D8/372
7,299,909 B1 * 11/2007 Houghton ..... B65G 39/071 193/35 R
7,316,638 B1 * 1/2008 Fabela ..... A63B 21/0628 482/93
7,520,843 B1 * 4/2009 Goddard ..... A63B 21/0724 482/104
7,594,874 B2 * 9/2009 Meissner ..... A63B 69/0048 482/36
7,699,756 B2 * 4/2010 Piane, Jr. ..... A63B 1/00 248/222.52
7,731,631 B2 * 6/2010 Collias ..... A63B 21/078 482/23
D622,620 S * 8/2010 Cloonan ..... D10/46.1
7,938,760 B1 * 5/2011 Webber ..... A63B 21/00181 482/137
8,038,581 B1 * 10/2011 Sudeith ..... A63B 69/0048 482/37
8,062,195 B2 * 11/2011 Israeli ..... A63B 1/00 482/131
8,147,389 B1 * 4/2012 Hoole ..... A63B 23/1227 482/100
8,251,757 B1 * 8/2012 Sun ..... H01R 4/38 439/783
8,328,698 B1 * 12/2012 Webber ..... A63B 21/078 482/104
8,517,900 B1 * 8/2013 Britt ..... A63B 21/0724 482/104
D691,219 S * 10/2013 Kessler ..... D21/672
8,739,982 B2 * 6/2014 Werner ..... F41C 33/06 206/317
8,808,151 B1 * 8/2014 Whaley ..... A63B 21/0442 482/129
8,864,608 B2 * 10/2014 Rockhill ..... A63B 69/3638 473/219
8,876,672 B2 * 11/2014 Schiano ..... A63B 21/078 482/104
8,992,229 B2 * 3/2015 Spital ..... G09B 19/22 434/259
8,998,781 B1 * 4/2015 Nelson ..... A63B 21/04 482/129
9,220,965 B1 * 12/2015 Hochberg ..... A63B 69/0075
9,248,021 B1 * 2/2016 Termanini ..... A61F 2/30721
9,498,676 B1 * 11/2016 Emick ..... A63B 23/04
2001/0034289 A1 * 10/2001 Parrillo ..... A63B 23/035 482/94
2002/0074208 A1 * 6/2002 Nimmo ..... B65G 39/02 193/35 R
2002/0127082 A1 * 9/2002 Carpenter ..... F16B 39/023 411/325
2002/0128132 A1 * 9/2002 LaFountain ..... A63B 21/4011 482/142
2002/0147086 A1 * 10/2002 Walsh ..... A63B 21/078 482/142
2003/0060333 A1 * 3/2003 Sudeith ..... A63B 69/0048 482/37
2004/0092369 A1 * 5/2004 Slawinski ..... A63B 21/00181 482/104
2004/0153026 A1 * 8/2004 Mackool ..... A61F 9/00745 604/22
2004/0230155 A1 * 11/2004 Blanco ..... A61B 17/3494 604/26
2005/0159278 A1 * 7/2005 McVay ..... A63B 21/068 482/142
2005/0233871 A1 * 10/2005 Anders ..... A63B 21/0724 482/93
2006/0063650 A1 * 3/2006 Francis ..... A63B 23/1209 482/94
2006/0182513 A1 * 8/2006 Dortch ..... F16B 23/0061 411/338
2007/0099773 A1 * 5/2007 Hummer ..... A63B 21/078 482/104
2007/0155594 A1 * 7/2007 Rogers ..... A63B 21/078 482/94
2007/0155596 A1 * 7/2007 Rogers ..... A63B 21/0615 482/97
2009/0146032 A1 * 6/2009 Bettenhausen ..... A61B 50/34 248/220.31
2010/0029403 A1 * 2/2010 Mayes ..... A63B 53/00 473/292
2010/0051769 A1 * 3/2010 Tyson ..... A47F 5/0807 248/220.31
2012/0261368 A1 * 10/2012 Klein ..... A47B 81/005 211/64
2012/0289384 A1 * 11/2012 Staten ..... A63B 21/0783 482/104
2012/0295780 A1 * 11/2012 Chou ..... A63B 23/12 482/142
2012/0329613 A1 * 12/2012 Schiano ..... A63B 21/078 482/94
2012/0329614 A1 * 12/2012 Schiano ..... A63B 21/078 482/104
2013/0065738 A1 * 3/2013 Henniger ..... A63B 21/0724 482/104
2014/0187391 A1 * 7/2014 Kelly ..... A63B 21/0724 482/104
2014/0296040 A1 * 10/2014 Mobley ..... A63B 21/078 482/104
2014/0364283 A1 * 12/2014 Moschel ..... A63B 21/062 482/94
2015/0016919 A1 * 1/2015 Tambornino ..... F16B 35/06 411/366.1
2015/0020369 A1 * 1/2015 Ryan ..... B24D 9/085 29/467
2015/0065316 A1 * 3/2015 Towley, III ..... A63B 21/00047 482/104

(56) References Cited

U.S. PATENT DOCUMENTS

| | | | | |
|---|---|---|---|---|
| 2015/0076092 | A1* | 3/2015 | Tambornino | A63B 21/078 211/85.7 |
| 2015/0202485 | A1* | 7/2015 | Towley, III | A63B 21/0628 482/104 |
| 2015/0290488 | A1* | 10/2015 | Hopperstad | A63B 21/078 482/38 |
| 2015/0343288 | A1* | 12/2015 | Taggart | A63B 69/0048 482/37 |

* cited by examiner

WEIGHT STORAGE PEG FOR FITNESS APPARATUS

CROSS-REFERENCE TO RELATED APPLICATION(S)

The present application claims priority from Provisional Application No. 61/896,834, filed Oct. 29, 2013 and entitled "Weight Storage Peg For Fitness Apparatus". The contents of U.S. provisional patent application Ser. No. 61/896,834 are hereby incorporated by reference in entirety.

FIELD OF THE INVENTION

The present invention relates to component parts used with fitness equipment superstructures, and particularly pegs for storing free weights used in barbell lifting exercises.

BACKGROUND OF THE INVENTION

Fitness equipment superstructures, also referred to as "rack and rig" systems, are in general known in the art. Examples are shown in U.S. Pat. Nos. 4,657,246, D635,206, D636,038, D636,039 and D636,040, U.S. Patent Pub. No 2013/0065738 and U.S. patent application Ser. No. 14/327,319, all incorporated by reference. These systems are mainly for and used in cross fit gyms, pull up rigs, and other athletic/exercise facilities.

One of the functions of the superstructures is to support and store "free weights", which are typically provided as circular plates, primarily of iron or steel, in different weights such as 2½, 5, 10, 25, 35 and 45 lbs. The free weight plates are commonly lifted on cylindrical metal weightlifting bars which extend within the central circular opening of the plates, with the plates symmetrically supported on opposing ends of the weightlifting bar. When not being used, the plates are typically stored on cylindrical pegs provided as part of the superstructures which are shaped similar to the ends of the weightlifting bars.

In some superstructures, the superstructures include vertically extending uprights, and the pegs are mounted or welded to the uprights so as to extend horizontally. Other superstructures have other configurations, such as a "Christmas tree" configuration, where the uprights are slanted off vertical at an angle, and the pegs mounted perpendicular to the uprights to extend at the complementary angle, with the free end of the peg higher than its attachment to the upright. However, mounting the weight pegs entirely horizontal generally makes it easier to place the free weight plates (particularly the 45 lb. plates) on the storage peg. In yet other situations, the weight storage pegs may be used on a movable part of the superstructure, with the weights used on the weight pegs (rather than on a bar) during exercising. Sometimes the pegs are welded to the superstructure, while in other situations the columns or uprights of the superstructure include a series of holes, which can be used for removably attaching weight storage pegs.

Most commonly, prior art weight storage pegs are either a cylindrical metal bar, or a cylindrical rod within a nylon casting. The line of thinking that the weight storage peg should mirror the shape and configuration of the portion of the weightlifting bar which holds the plates during exercising is prevalent. While such weight storage pegs may be standard in the industry, improvements are possible.

BRIEF SUMMARY OF THE INVENTION

The present invention is a weight storage peg for supporting free weight plates from an exercise superstructure, and an exercise superstructure which uses such weight storage pegs. The weight storage peg is primarily a bar extending from a fastener, with the bar being small enough in thickness to fit within the central circular opening of a free weight plate. An exterior surface of the bar tapers from a wider portion adjacent the free end to a narrower portion nearer the fastener. In one aspect, the taper is provided by casting a softer material around a metal core weldment, with the metal core weldment consisting of a cylindrical tube welded to a mating mounting bolt.

While the above-identified drawing figures set forth preferred embodiments, other embodiments of the present invention are also contemplated, some of which are noted in the discussion. In all cases, this disclosure presents the illustrated embodiments of the present invention by way of representation and not limitation. Numerous other minor modifications and embodiments can be devised by those skilled in the art which fall within the scope and spirit of the principles of this invention.

DETAILED DESCRIPTION

Figure 1:
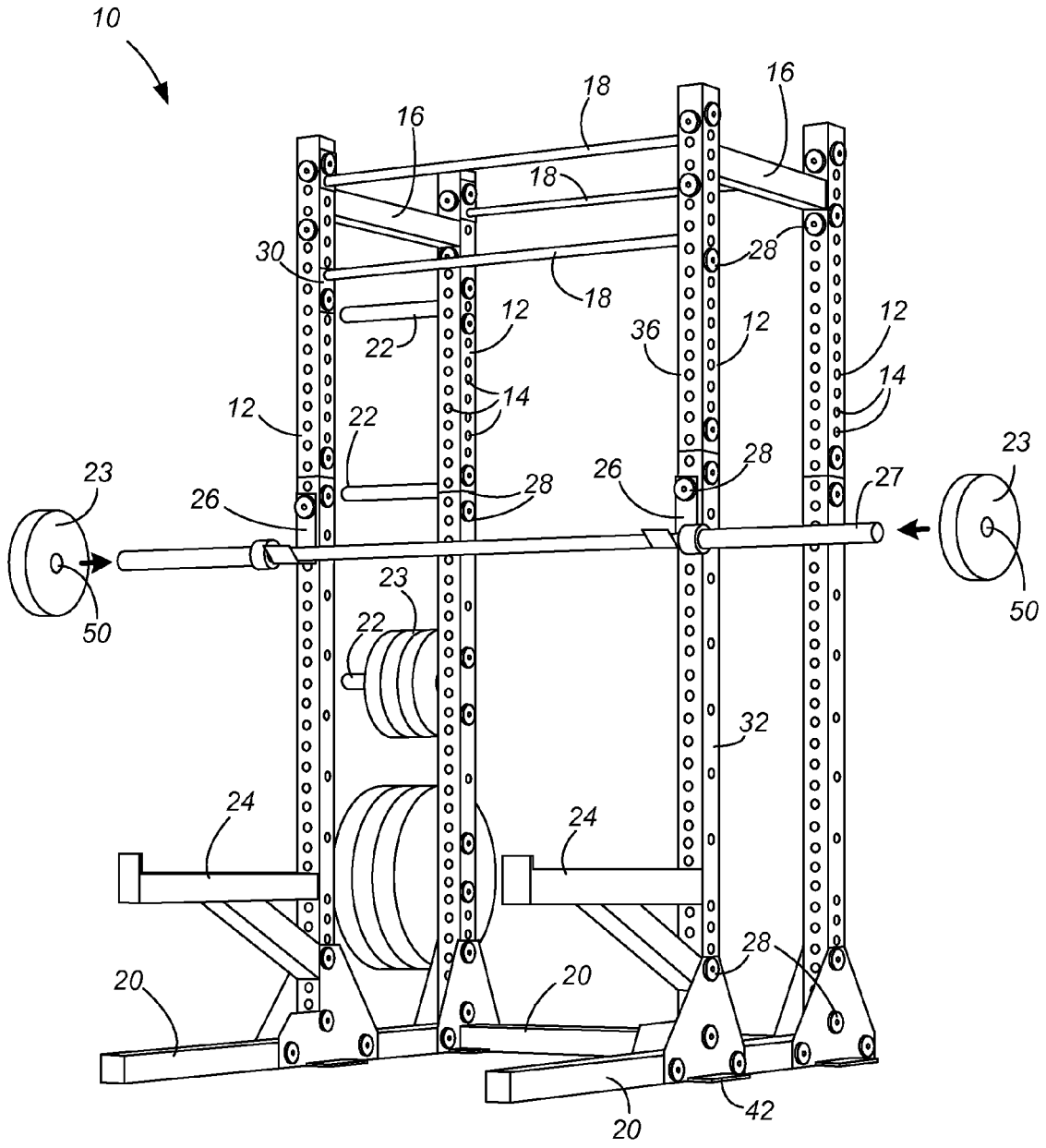
FIG. 1 is a perspective view of an exemplary fitness superstructure using four of the preferred weight storage pegs of the present invention.
Figures 2, 3, 4, 5, 6:
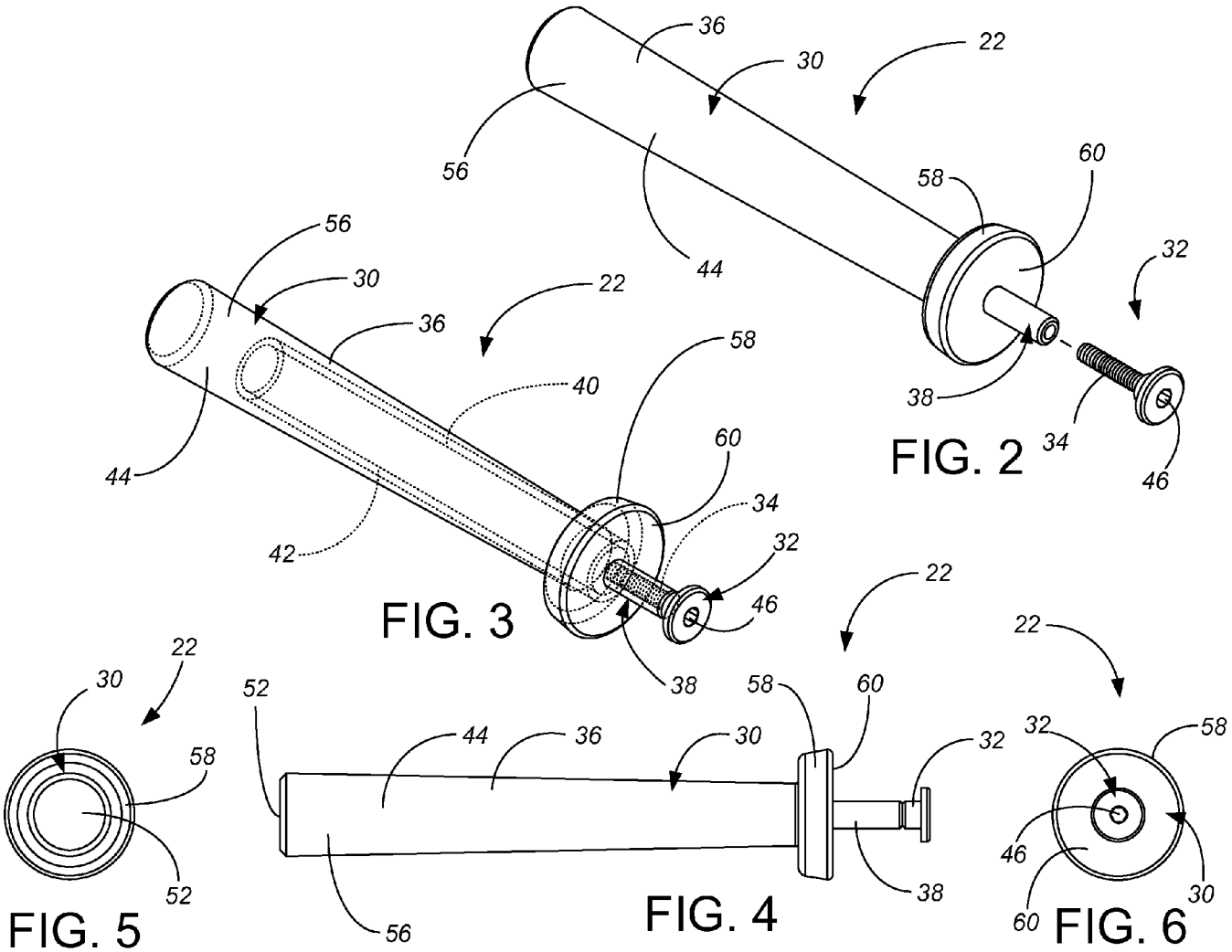
FIG. 2 is a perspective, assembly view of one first embodiment of a weight storage peg in accordance with the present invention.
FIG. 3 is a perspective, assembled view of the weight peg of FIG. 2, showing hidden structure with dashed lines.
FIG. 4 is a side view of the weight peg of FIGS. 2 and 3.
FIG. 5 is a distal end view of the weight peg of FIGS. 2-4.
FIG. 6 is a proximal end view of the weight peg of FIGS. 2-5.
Figure 8:
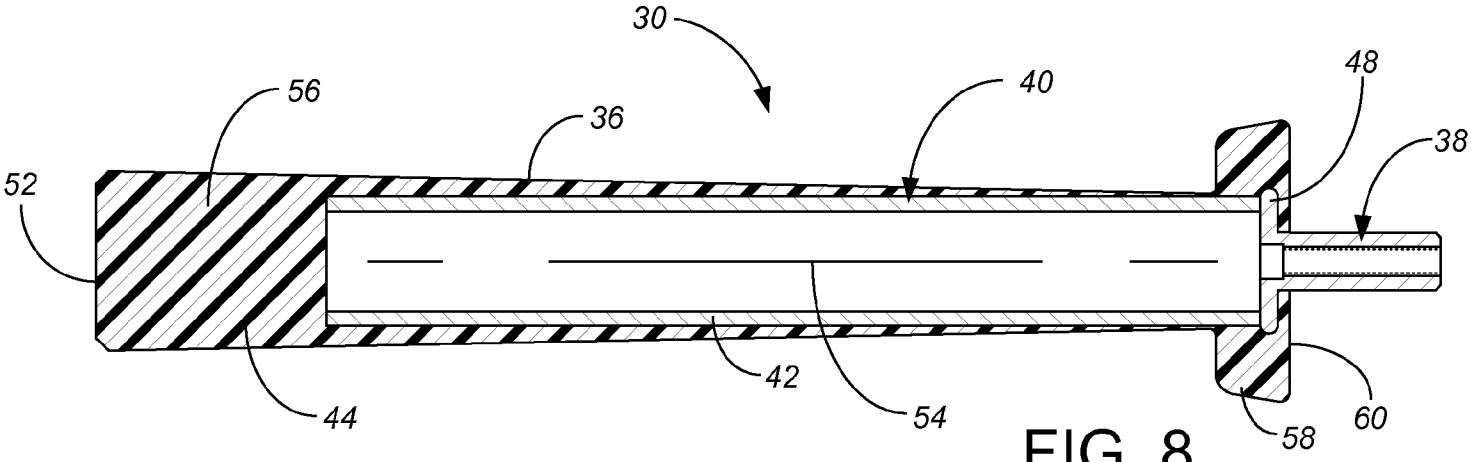
FIG. 8 is a cross-sectional view of the coated peg weldment, taken along cut lines 8-8 in FIG. 7.
Figure 7:
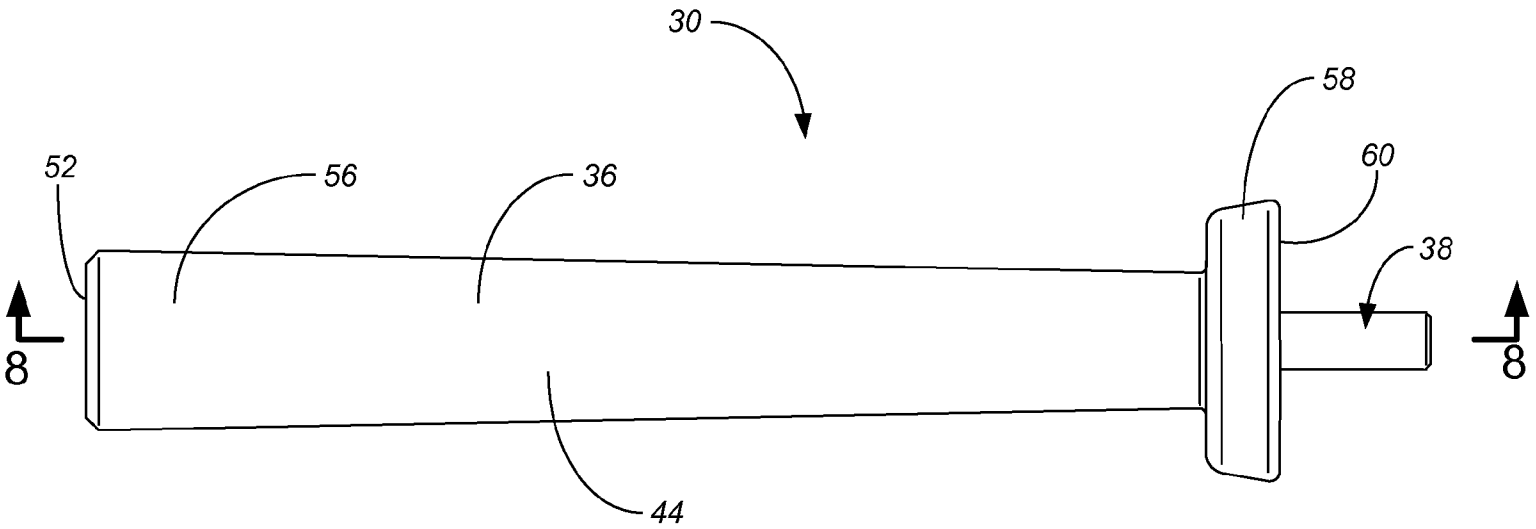
FIG. 7 is a side view of the coated peg weldment used in the weight peg of FIGS. 2-6.
Figure 9:
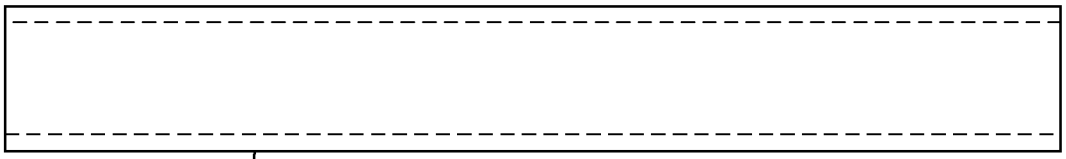
FIG. 9 is a side view of the peg core used in the weight peg of FIGS. 2-6.
Figure 10:
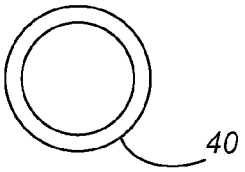
FIG. 10 is an end view of the peg core of FIG. 9.
Figure 11:
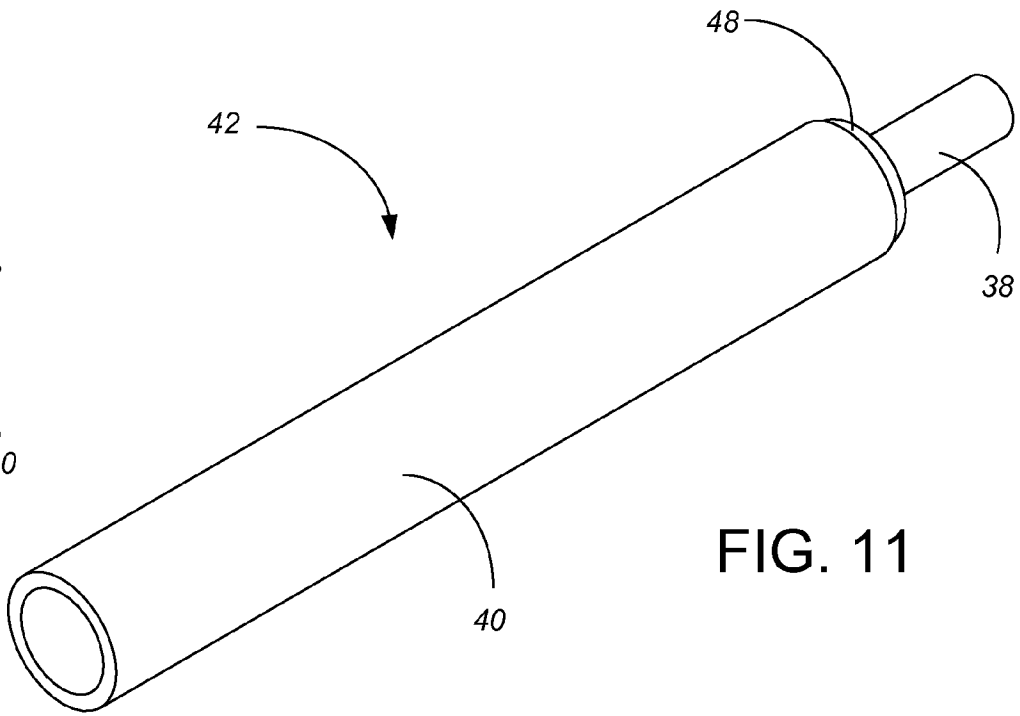
FIG. 11 is a perspective view of the uncoated peg weldment used in the weight peg of FIGS. 2-6.
Figure 12:
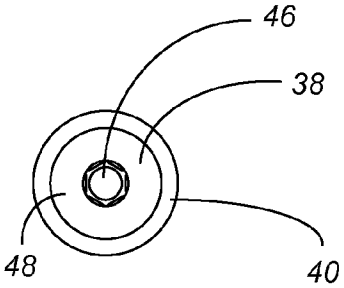
FIG. 12 is a distal end view of the uncoated peg weldment of FIG. 11.
Figure 13:
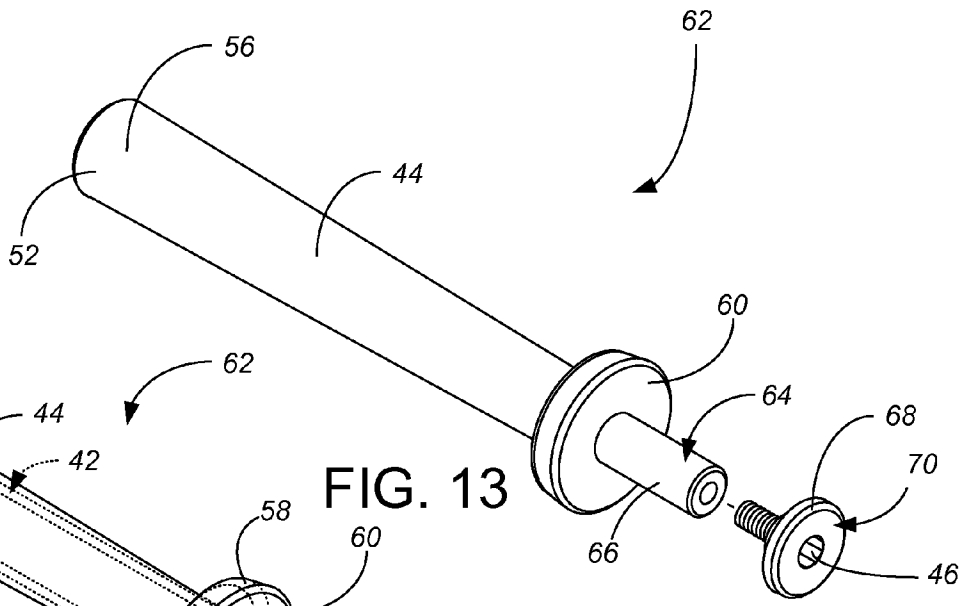
FIG. 13 is a perspective, assembly view of a second embodiment of a weight peg in accordance with the present invention.
Figure 14:
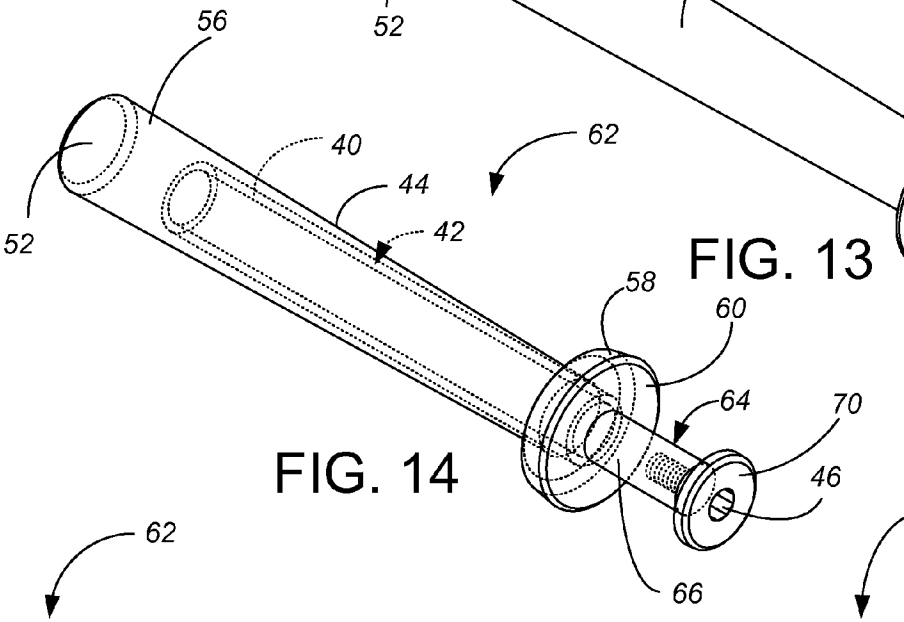
FIG. 14 is a perspective, assembled view of the weight peg of FIG. 13, showing hidden structure with dashed lines.
Figure 15:
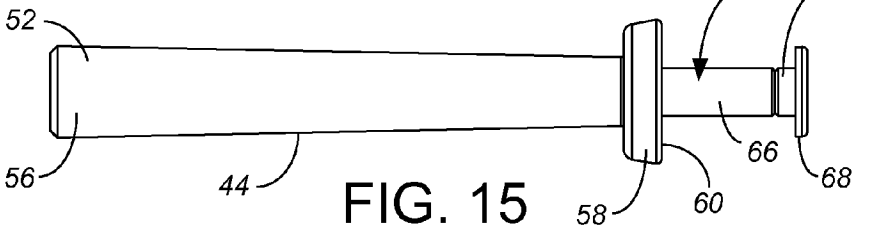
FIG. 15 is a side view of the weight peg of FIGS. 13 and 14.
Figure 16:
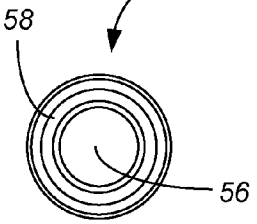
FIG. 16 is a distal end view of the weight peg of FIGS. 13-15.
Figure 17:
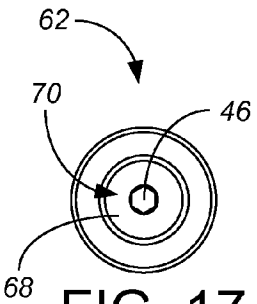
FIG. 17 is a proximal end view of the weight peg of FIGS. 13-16.
Figure 19:
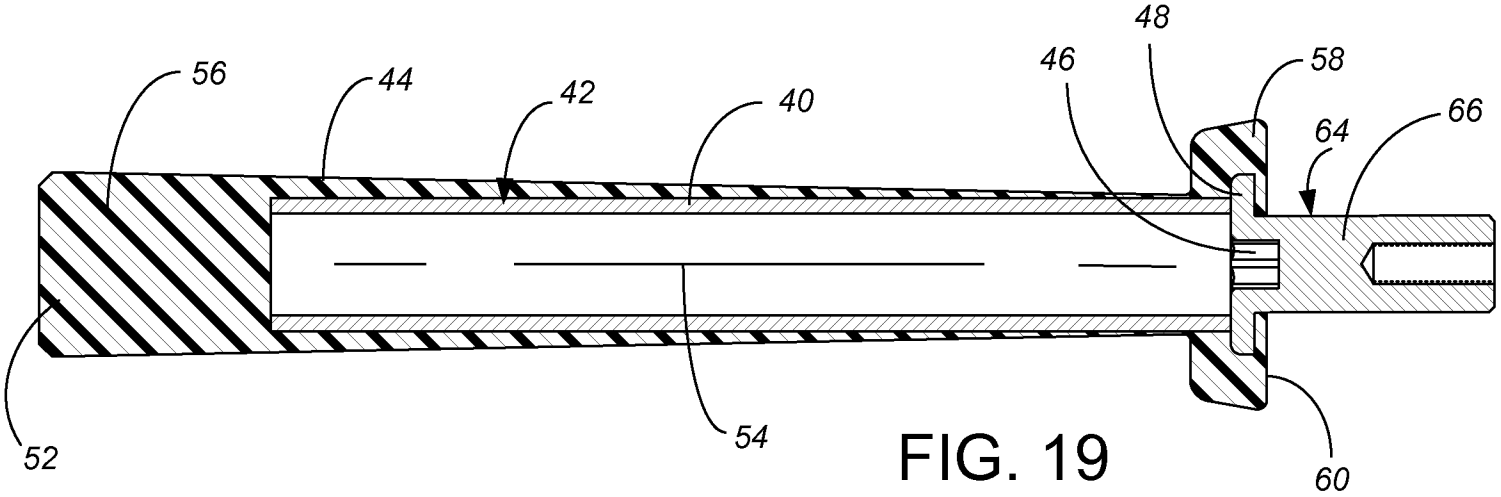
FIG. 19 is a cross-sectional view of the coated peg weldment, taken along cut lines 19-19 in FIG. 18.
Figure 18:
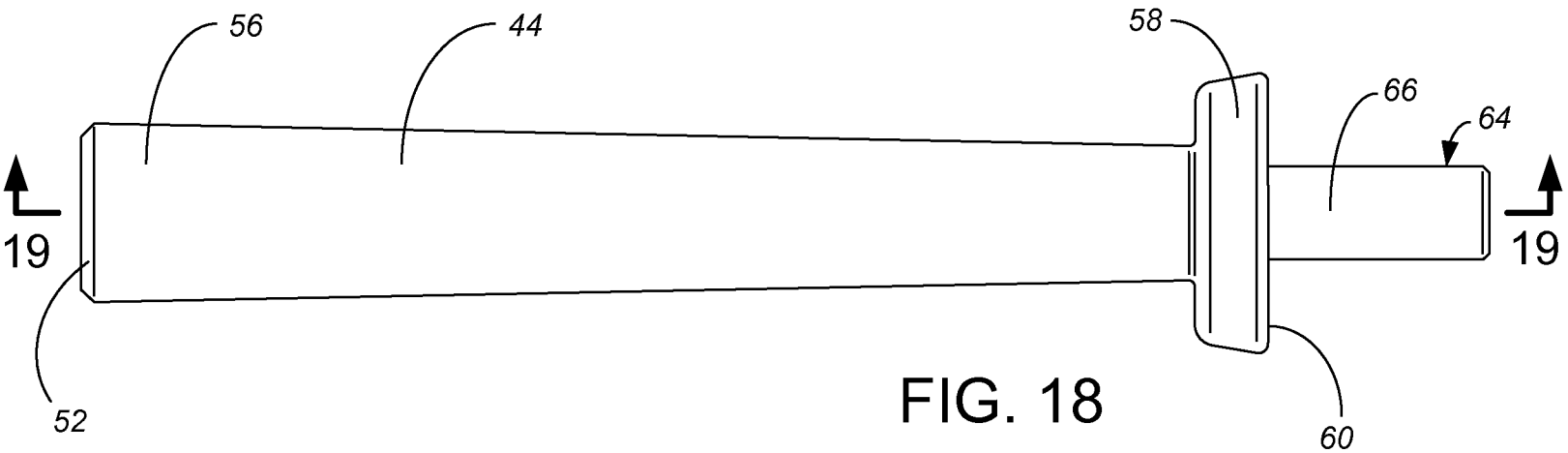
FIG. 18 is a side view of the coated peg weldment used in the weight peg of FIGS. 13-17.
Figure 20:
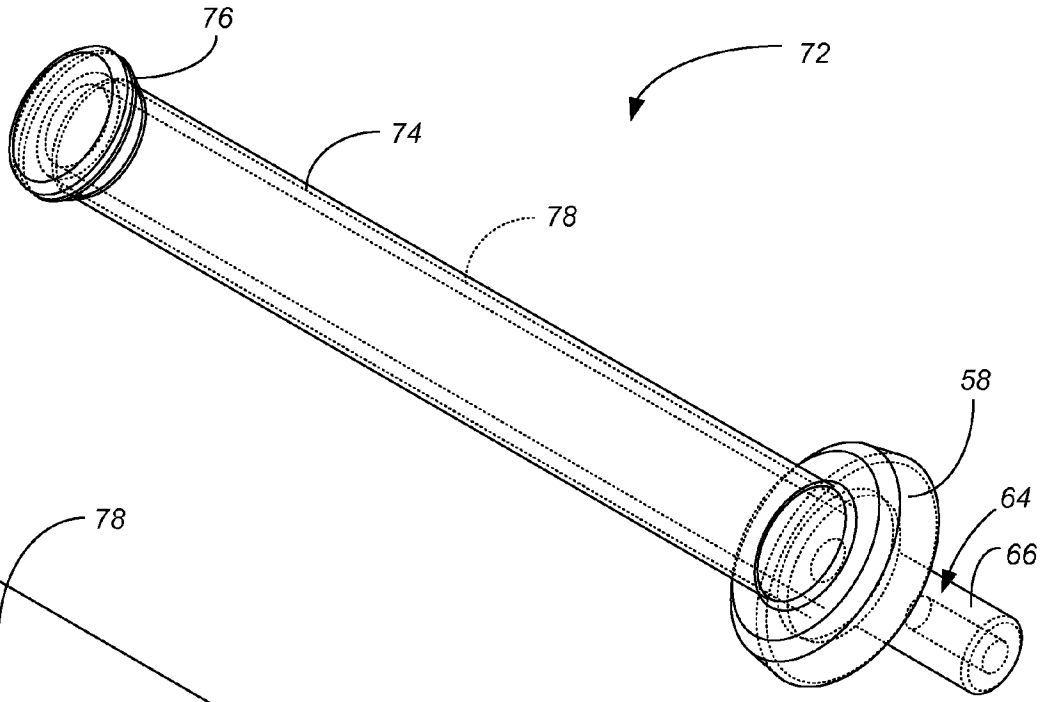
FIG. 20 is a perspective view of a third embodiment of a coated peg weldment in accordance with the present invention, showing hidden structure with dashed lines.
Figure 21:
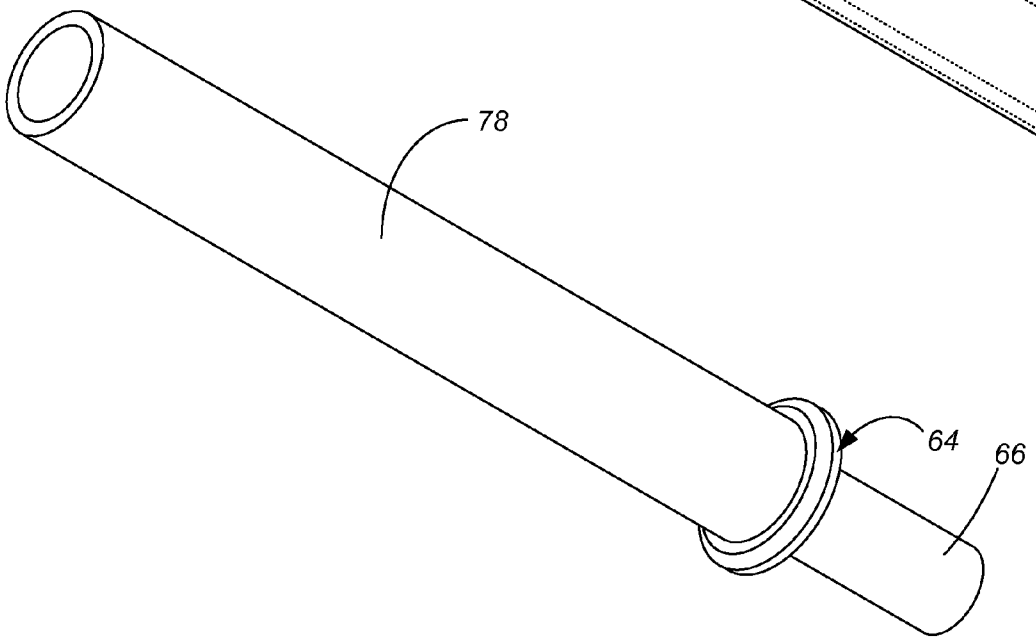
FIG. 21 is a perspective view of the peg weldment used in FIG. 20.
Figure 23:
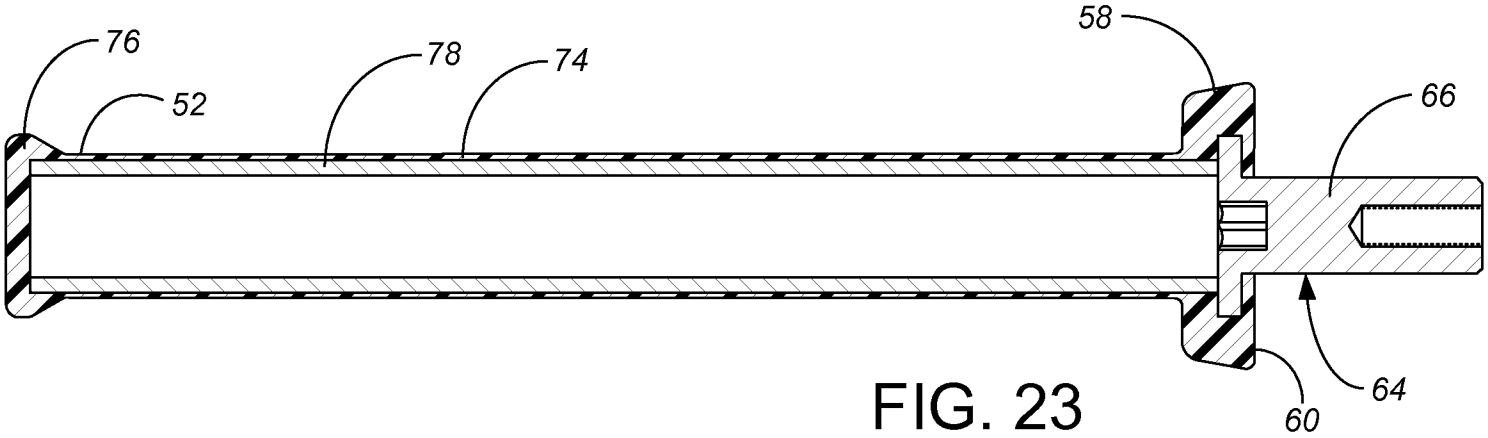
FIG. 23 is a cross-sectional view of the coated peg weldment of FIGS. 20 and 22, taken along cut lines 23-23 in FIG. 22.
Figure 22:
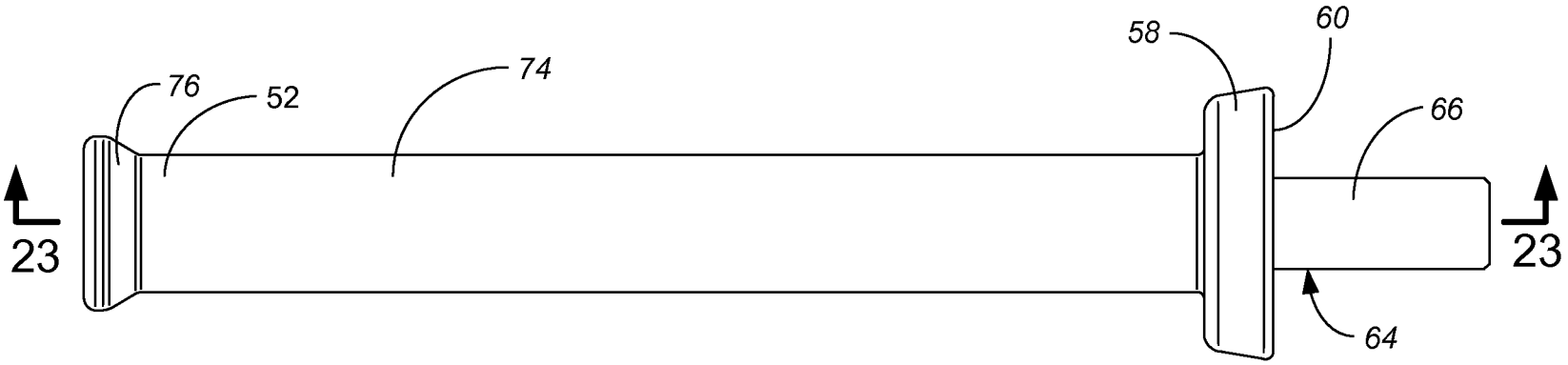
FIG. 22 is a side view of the coated peg weldment of FIG. 20.

As shown in FIG. 1, a fitness equipment superstructure 10 has, in this example, four columns or uprights 12. In this preferred embodiment, each of the uprights 12 is formed with a rectangular horizontal cross-section, such as from 2×3 inch or 3×3 inch metal tubing. The preferred uprights 12 are about 8 or 9 feet long (shown as 9 feet long), formed from rectangular steel tubing.

Each upright 12 has a series of holes 14 running along its height, which can be used to fasten supports and accessories to the uprights 12. The preferred holes 14 are about ⅝ or 1 inch in diameter, spaced at regular intervals along the height of the upright 12, such as at about 2 inch and about 6 inch intervals as desired for mounting hardware to and assembling the fitness equipment superstructure 10. Slightly different sized holes can be used for fastening supports and accessories, particularly if different sized tubing is used. The preferred uprights 12 and superstructure 10 are shown in more detail in U.S. patent application Ser. No. 14/488,011 filed Sep. 16, 2014, incorporated by reference.

In this example, the uprights 12 are attached together at their tops with two rectangular cross-bars 16 running from front-to-back, as well as three smaller circular cross-bars 18 running from side-to-side, two in front and one in back. The circular cross-bars 18 can be used, for instance, for pull-ups or similar exercises. The bases of the uprights 12 are secured together with floor beams 20. Bench or seat supports 24 are attached extending forward from each of the front uprights 12. J-cups 26, which can be used to support a weightlifting bar 27, are attached facing forward from each of the front uprights 12. In this preferred embodiment, each of the attachments to the uprights 12 are achieved with one or more fasteners 28. The preferred fasteners 28 are shown in more detail in U.S. patent application Ser. No. 14/327,319 filed Jul. 9, 2014, incorporated by reference. It can readily be understood that a wide variety of different configurations of fitness equipment superstructure set-ups can be achieved with these and similar uprights and accessories, including many configurations which use more than four uprights 12.

Four of the inventive weight pegs 22 are attached to one of the rear uprights 12. The weight pegs 22 can be used to hold weightlifting plate freeweights 23, such as by having a length within the range of 6 to 18 inches. The construction of a first preferred weight peg 22 is better shown in FIGS. 2-12. Each weight storage peg 22 includes two parts, a coated peg weldment 30 and a mating bolt 32. Exterior threads on a threaded shaft 34 of the mating bolt 32 are received by interior threads on the coated peg weldment 30, inside the uprights 12 of the superstructure 10. Thus, the mating bolt 32 serves as a fastener for attachment of the weight peg 22 to the exercise superstructure 10. An exterior surface 36 of each weight peg 22 tapers from a wider portion adjacent the free end 52 to a narrower portion nearer the fastener 32.

The coated peg weldment 30 is formed from at least two and more preferably three components, shown in more detail in FIGS. 3 and 8-12. The preferred process for forming the coated peg weldment 30 involves welding a female threaded mating bolt 38 to a hollow cylindrical peg core 40 to form a core weldment 42, and then casting a softer material 44 around the core weldment 42. Alternatively, a male threaded mating bolt can be welded to the peg core 40, with a female threaded mating bolt used as a separate part. For either of these scenarios, the mating bolts 32, 38 can be as shown in more detail in U.S. patent application Ser. No. 14/327,319 filed Jul. 9, 2014, incorporated by reference. Using a female threaded mounting bolt 38 in the core weldment 42 reduces the likelihood that the threads (on the more expensive weldment part 42) will get damaged during assembly and otherwise when the storage peg 22 is used. The preferred welding is with E70S-6 MIG welding wire (not shown). Since the mating bolts 32, 38 shown have separate uses other than in the storage peg 22, each has a central hexagonal recess 46 for tightening via an allen wrench tool (not shown), even though the recess 46 inside the coated peg weldment 30 (on the female threaded mating bolt 38, shown in FIG. 12) is completely extraneous and unused. The female threaded mating bolt 38 has a head 48 which preferably provides a flat welding surface/edge where it contacts the end of the weight peg core 40. Other ways to join the mating bolt 38 to the peg core 40, such as adhesive, could alternatively or additionally be used. As another alternative, the metal interior portion of the storage peg 22 could be formed by machining out of a larger metal bar. As yet a further alternative, a different type of fastener (not shown) could be used to attach the storage peg 22 to the superstructure 10, including welding the peg 22 to the superstructure 10.

The preferred peg core 40 is a hollow cylinder formed from a strong metal such as ASTM A500 Grade B steel tubing. The diameter or thickness of the peg core 40 must be smaller than the circular openings 50 in the weight plates 23 which are used to mount the weight plates 23 on the weightlifting bar 27. If hollow, the wall thickness needs to be thick enough to support the weight of the weight plates 23, including when one or more weight plates 23 are cantilevered on the end of the peg 22. Using a hollow weight peg core 40 lightens the storage peg 22, while the tube material provides sufficient strength to the peg 22. The peg core 40 could be slightly tapered, but in the preferred embodiment is entirely cylindrical. In the preferred embodiment shown in FIGS. 1-12, the peg core 40 is 10 inches in length, with an outer diameter of 1.38 inches and a wall thickness of 0.16 inches. The head 48 of the preferred female threaded mating bolt 38 is circular, with an outer diameter of 1.25 inches. The welded E70S-6 connection, circular at about a 1.25 inch diameter, is sufficiently strong to support the moments witnessed by the coated peg weldment 30 during normal use even with 45 lb. plates.

Nylon (preferably black, nylon 6) or a similar castable polymer material is cast around the core weldment 42. The noun "casting" as used herein, refers to the softer, more compressible non-metal material 44 even if formed by a different method. If the core is tapered, the casting can have a constant wall thickness. More preferably, the casting 44 is tapered. The taper makes it so the free weights 23 cannot slide off the storage peg 22 easily even when the coated peg weldment 30 is mounted horizontally. The wider, free end 52 of the storage peg 22 has a thickness which fits within the central circular opening 50 of a free weight plate 23 of no greater than 2.2 inches in diameter. While the taper could have a changing profile or only be on one side of the peg 22 which was directed upward, more preferably the taper is conical about the central axis 54 of the peg 22. By being conical, the top side of the peg 22 provides a uniformly sloped surface for the weight plates 23, regardless of the circumferential position of the peg 22 when tightened to the superstructure 10. When supporting the free weights 23, the cone angle should be within the range of 1 to 20°, more preferably within the range of 1 to 10° and more preferably within the range of 2 to 3°. The preferred embodiment provides a 2.31° taper over the majority of a 12 inch length, from a minimum (i.e., proximal) outer diameter of 1.45 inches to a maximum (i.e., distal) outer diameter of 1.92 inches. This provides a casting thickness over the peg core 40 varying from about 0.035 to about 0.230 inches.

The casting 44 preferably provides a tip 56 which extends past the end of the peg core 40, so as to cover the end of the metal core 40. Having the casting 44 extend beyond the end of the peg core 40 provides some limited compression to the end of the storage peg 22, helping minimize injury to an athlete inadvertently contacting the free end 52 of the storage peg 22 while moving around the gym apparatus. At the same time, the distal tip 56 or free end 52 of the storage peg 22 can still support the last free weight 23 when several free weights 23 are stacked nearly all the way to the end of the storage peg 22. To provide more compression to the tip 56, the length of the tip 56 is greater than all wall thicknesses of the casting 44 over the peg core 40. The preferred tip 56 extends a little more than 2 inches beyond the end of the peg core 40.

A mounting flange 58 is formed out of the casting 44 around the welded connection between the female threaded mating bolt 38 and the weight peg core 40. The mounting flange 58 provides a flat abutment surface 60 perpendicular to the longitudinal axis 54 of the peg 22, so when the peg 22 is attached to the superstructure 10 with the mating bolt 32, the longitudinal axis 54 of the peg 22 is perpendicular to the vertical longitudinal axis of the upright 12. The mounting flange 58 is preferably larger than the central circular opening 50 of the free weight plates 23, such as a diameter of wider than 2.5 inches, with a preferred diameter of about 3 inches. With at least a 2.5 inch diameter, the mounting flange 58 helps support moments and helps hold the weight storage peg 22 perpendicular to the upright 12 of the superstructure 10. If desired, the mounting flange could alternatively be polygonal, rather than circular. When in use, the longitudinal axis 54 of the weight storage peg 22 extends perpendicular to the longitudinal axis of the superstructure 10, i.e., the storage peg 22 extends horizontal when used with a vertically extending upright 12. In the first preferred embodiment, when tightened the head of the mating bolt 32 is about 2 inches from the flat abutment surface 60 of the mounting flange 58.

FIGS. 13-19 show a second embodiment of a weight storage peg 62 in accordance with the present invention. A significant difference between the first embodiment shown in FIGS. 1-12 and the second embodiment shown in FIGS. 13-19 is the size of the superstructure with which the weight storage peg is used, with the second embodiment 62 used with superstructure uprights which are thicker and with wider holes. Accordingly, the female mating bolt 64 has a thicker shaft 66 to mate with about a 1 inch diameter hole, with the head 68 of the male mating bolt 70 being wider (about 1.88 rather than 1.25 inches in diameter) as well as further (about 3 inches rather than about 2 inches) from the flat abutment surface 60 of the mounting flange 58.

FIGS. 20-23 show a third embodiment of a weight storage peg 72 in accordance with the present invention. In this third embodiment, the majority of the length of the storage peg 72 is parallel to its longitudinal axis 54 (i.e., not tapered or conical, but instead cylindrical) for supporting free weight plates 23, and instead the casting 74 is shaped with a knob 76 on the end 52 of the storage peg 72. Similar to the 2.31° taper in the first two embodiments, the knob 76 is formed entirely in the cast softer material 74. The knob 76 helps prevent the free weight plates 23 from inadvertently sliding off the free end 52 of the storage peg 72. The preferred knob 76 provides a taper of about 30° extending for about ⅓ inch.

The storage peg 72 also uses a longer core 78, with core 78 being about 12 inches in length rather than the 10 inch length of core 40. Similar to the first two embodiments, the metal core 78 inside of the storage peg 72 is formed by welding a cylindrical tube to a female mounting bolt 64, and using the casting 74 to provide the entire taper/knob helping to prevent the free weight plate 23 from inadvertently sliding off the end 52 of the storage peg 72. In this way, less expensive, stock cylindrical mounting bolts 32, 38, 64, 70 and cores 40, 78 can be used, rather than forming the taper in a custom steel part.

Workers skilled in the art will appreciate that various changes can be made while keeping within the present invention. For instance, different amounts of taper (preferably between 1 and 10°) and different specific dimensions can be used.

What is claimed is:

1. A weight storage peg for supporting free weight plates from an exercise superstructure, comprising:

a fastener for attachment to the exercise superstructure; and a bar extending from the fastener to a distal free end and defining a central axis, the bar having a thickness adjacent the free end which, when in use, fits within a central circular opening of a free weight plate of no greater than 2.2 inches in diameter, and the bar and fastener having sufficient strength to fully support one or more free weight plates each weighing 25 pounds or more with the bar configured to be cantilevered from the exercise superstructure using the fastener and configured to horizontally extend through the central opening of each of the supported free weight plates;

wherein the bar comprises a metal core inside a non-metal sleeve, the non-metal sleeve being more compressible than the metal core;

wherein the metal core is cylindrical with a generally continuous thickness, and the non-metal sleeve has a varying thickness providing a taper from a wider portion adjacent the free end to a narrower portion nearer the fastener wherein the taper is conical;

wherein the non-metal sleeve comprises a tip which extends longitudinally beyond and covers the distal end of the metal core;

wherein the fastener comprises a bolt, the bolt having a head and a threaded shaft, the threaded shaft being threadably receivable within a cavity formed in a proximal end along the central axis of the weight storage peg.

2. The weight storage peg of claim 1, further comprising a flange at a proximal end of the bar, the flange providing an abutment surface which is perpendicular to the central axis of the bar, the flange in conjunction with the fastener causing the central axis to be perpendicular to an attachment surface of the exercise superstructure.

3. The weight storage peg of claim 2, wherein the flange is wider than 2.5 inches.

4. The weight storage peg of claim 1, wherein the taper defines a cone angle within the range of 1 to 20 degrees.

5. The weight storage peg of claim 4, wherein the taper defines a cone angle within the range of 2 to 3 degrees.

6. The weight storage peg of claim 1, wherein the length of the tip is greater than all wall thicknesses of the non-metal sleeve over the metal core.

7. The weight storage peg of claim 1, wherein the metal core is a hollow tube.

8. The weight storage peg of claim 1, wherein the bar has a length within the range of 6 to 18 inches, and while being cantilevered from the exercise superstructure can horizontally extend through central openings of the free weight plates to fully support at least two 45 pound free weight plates.

* * * * *